US008857872B2

(12) United States Patent
Olivier

(10) Patent No.: US 8,857,872 B2
(45) Date of Patent: Oct. 14, 2014

(54) CONVERTIBLE TRANSPORTER BASKET

(75) Inventor: Pierre L. Olivier, Houma, LA (US)

(73) Assignee: Integris Rentals, L.L.C., Houma, LA (US)

( * ) Notice: Subject to any disclaimer, the term of this patent is extended or adjusted under 35 U.S.C. 154(b) by 0 days.

(21) Appl. No.: 13/700,048

(22) PCT Filed: May 26, 2011

(86) PCT No.: PCT/US2011/038186

§ 371 (c)(1), (2), (4) Date: Nov. 26, 2012

(87) PCT Pub. No.: WO2011/150236

PCT Pub. Date: Dec. 1, 2011

(65) Prior Publication Data

US 2013/0062897 A1 Mar. 14, 2013

Related U.S. Application Data

(60) Provisional application No. 61/348,459, filed on May 26, 2010.

(51) Int. Cl.

| | |
|---|---|
| ***B66C 1/16*** | (2006.01) |
| ***B65D 19/12*** | (2006.01) |
| ***B65D 90/00*** | (2006.01) |
| ***B65D 88/52*** | (2006.01) |
| ***B65D 19/38*** | (2006.01) |
| ***B65D 88/12*** | (2006.01) |

(52) U.S. Cl.

CPC . *B65D 19/12* (2013.01); *B66C 1/16* (2013.01); *B65D 90/0033* (2013.01); *B65D 88/528* (2013.01); *B65D 19/38* (2013.01); *B65D 88/123* (2013.01)

USPC ..... 294/68.1; 294/68.3

(58) Field of Classification Search

USPC ..... 294/68.1, 68.3, 67.1, 82.1; 220/1.5; 108/55.1

See application file for complete search history.

(56) References Cited

U.S. PATENT DOCUMENTS 3,521,924 A * 7/1970 Wallenius ..... 294/67.1
3,570,698 A * 3/1971 Dougherty ..... 220/1.5

(Continued)

FOREIGN PATENT DOCUMENTS

KR 20-0440436 Y1 6/2008

OTHER PUBLICATIONS

International Search Report and Written Opinion of International Searching Authority for Application No. PCT/US2011/038186.

*Primary Examiner* — Paul T Chin

(74) *Attorney, Agent, or Firm* — Garvey, Smith, Nehrbass & North, L.L.C.; Seth M. Nehrbass; Charles C. Garvey

(57) ABSTRACT

A transporter for holding articles to be lifted includes a base having a plurality of perimeter beams connected to a plurality of transverse interior beams, the base having a load carrying deck with a load carrying surface, and the deck extending above the transverse beams and to the perimeter beams. There are a plurality of wall panels including multiple removable wall panels that can each be removably affixed to the base, and a plurality of lifting eyes secured to the base externally of the walls. There are multiple cutout openings in the walls, each cutout enabling a diagonally placed lifting line to extend from one of the lifting eyes, through the opening and upwardly of the base to a position above the central portion of the deck. A winch rail extends along the upper surface of one of the perimeter beams. At least one of the wall panels with a cutout opening is one of the removable wall panels.

20 Claims, 13 Drawing Sheets

(56) References Cited

U.S. PATENT DOCUMENTS

| | | | | | |
|---|---|---|---|---|---|
| 3,710,973 | A | | 1/1973 | Franks | |
| 3,807,581 | A | * | 4/1974 | Nichols | 206/600 |
| 4,050,604 | A | | 9/1977 | Flanders | |
| 4,416,385 | A | * | 11/1983 | Clare et al. | 220/1.5 |
| 4,915,033 | A | * | 4/1990 | Bond | 108/55.1 |
| 5,111,950 | A | | 5/1992 | Wylenzek | |
| 5,344,203 | A | | 9/1994 | Tollenaere | |
| 5,533,456 | A | * | 7/1996 | Regina | 108/57.29 |
| 5,577,687 | A | * | 11/1996 | Downing | 244/110 E |
| 6,598,540 | B2 | * | 7/2003 | Austin et al. | 108/51.11 |
| 6,848,539 | B2 | * | 2/2005 | Lee et al. | 182/128 |
| 7,763,200 | B2 | * | 7/2010 | Linares | 264/275 |
| 7,870,970 | B2 | * | 1/2011 | Fisk | 220/7 |
| 2004/0188433 | A1 | | 9/2004 | Morales et al. | |
| 2008/0272136 | A1 | | 11/2008 | Schmidl et al. | |
| 2009/0272738 | A1 | | 11/2009 | Marcel | |

* cited by examiner 15
16
21
18

CONVERTIBLE TRANSPORTER BASKET

CROSS-REFERENCE TO RELATED APPLICATIONS

Priority of U.S. Provisional Application Ser. No. 61/348,459, filed 26 May 2010, hereby incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a transportable, liftable cargo basket that is convertible from a walled transporter to a transporter not having walls. More particularly, the present invention relates to an improved cargo transportation apparatus that can be lifted by means of a crane or by means of a forklift and wherein specially configured lifting eyes are placed on a perimeter beam and externally of removable walls, the perimeter beam is also carrying a winch rail having multiple winches that are able to slide to a select position relative to a cargo deck of the apparatus.

2. General Background of the Invention

Cargo baskets and like transporters have been used for the transportation of heavy goods. One of the most common uses of a cargo basket is the lifting of cargo from a dock or land based structure to a marine structure such as a vessel. In the offshore marine environment, such cargo baskets are often used to transport heavy loads from a boat to a marine platform such as an oil drilling or production platform.

Some cargo baskets have been patented. One example is U.S. Pat. No. 3,710,973 entitled "Shipping and Display Container."

This patent discloses a box for transport and display, with removable walls and has a section whereby it may be lifted by a fork lift. Its abstract reads as follows: "A multi-sided, large shipping container which also serves as a display container once the merchandise is placed on sale such as in a supermarket or other store. Particularly useful for shipping and selling merchandise which may be handled by forklift trucks, the container has four wall sections each made from rigid frames and panels of plywood or other material with interlocking brackets at the bottom edges fastened to the reinforced bottom which has a pallet to accommodate the fork on a forklift truck and may or may not have wheels on the bottom. A one-piece top has edges which fit down over the respective upper edges of each wall section for quick detachment therefrom. Other brackets are provided at intermediate heights on selected wall sections to latch them together. The merchandise which may be in the form of smaller boxes or cartons of goods or not containerized is stacked on the bottom of the present container which resembles a pallet. Then the wall sections are assembled in place by aligning interlocking brackets and inserting interlocking pins on one bracket into openings in matching bracket portions. Then the entire container may be lifted by a forklift truck and transported by truck, aircraft or boxcar to the store where it is placed for display and actual sale of the merchandise by removing one or more of the wall sections."

U.S. Pat. No. 4,050,604—"Disassembleable, reusable container" discloses collapsible containers which can be assembled and disassembled and used with a fork lift. In col. 2, beginning at line 51, it states: "In contradistinction to the prior art containers which require support on a pallet or like device for use in conjunction with a standard fork lift, the subject, disassemblable container is preferably supported by its own bracing members above the surface on which it is supported. Therefore, there is adequate room for the forks of a standard lift truck to be inserted under the container so that it may be easily transported from one place to another."

US Published Patent Application No. 20040188433—"Convertible, transport, cargo box system" discloses a cargo box with a top which opens and sliding sides. In FIG. 3C, one can see the slots whereby it may be picked up by a forklift. It is a rectangular box whereby one side can completely slide open (as in two gates slide away from each other) and the top can open and tuck behind a side.

US Published Patent Application No. 20080272136. Its abstract reads as follows: "In a transport case for transport of at least one high value, heavy transport goods, a floor is provided on which an object carrier is arranged on an inside of the case such that it can be displaced in a direction of a longitudinal axis of the case. At least one cover is connected with the floor with at least one hinge such that it can be folded over and the cover can be opened such that the transport good is freely accessible parallel to the longitudinal axis in an opened state of the transport case." Please see for example FIG. 2, which shows that in one embodiment the box can open by having the entire top and walls fold over, and FIG. 7, which shows that in one embodiment the box can opened by sliding the walls outwardly. Also, a fork lift can lift from under the floor plate as the case is designed to be able to be picked up by standard fork lifts.

US Published Patent Application No. 20090272738 describes a cargo basket used for transportation of cargo in which there are fork slots for a forklift as well as one side which is made up of two gates (420 and 424) which may be removed for loading/unloading purposes (please see the figures).

BRIEF SUMMARY OF THE INVENTION

The present invention provides a transporter for holding articles to be lifted. The apparatus includes a base having a plurality of perimeter beams, a plurality of transverse interior beams spanned between perimeter beams. The base provides a load carrying deck with a load carrying surface. The deck extends above the transverse beams and to the perimeter beams.

A plurality of wall panels include removable wall panels that can each be removably affixed to the base at a position next to the perimeter beams. Some of the wall panels are end wall panels. Some of the wall panels are side wall panels.

A plurality of lifting eyes are secured to the base externally of the removable wall panels.

Cutouts are provided on the side wall which enable a diagonally placed lifting line to extend from a lifting eye upwardly to the opening to a position above the central area of the deck.

At least one of the side walls having cutouts is a removable wall panel.

In one embodiment, there are two side wall panels, each having a cutout that enables a diagonally placed lifting line to extend from the lifting eye through the opening and upwardly to a position above the center of the deck.

In one embodiment, a winch rail extends along the upper surface of one of the perimeter beams. In one embodiment, a plurality of winches are mounted in the winch rail, each being slidably movable to a selected position along the frame.

In one embodiment, the winch rail extends generally in between a pair of the lifting eyes. In one embodiment, the base has four corners and a lifting eye as positioned at each corner.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
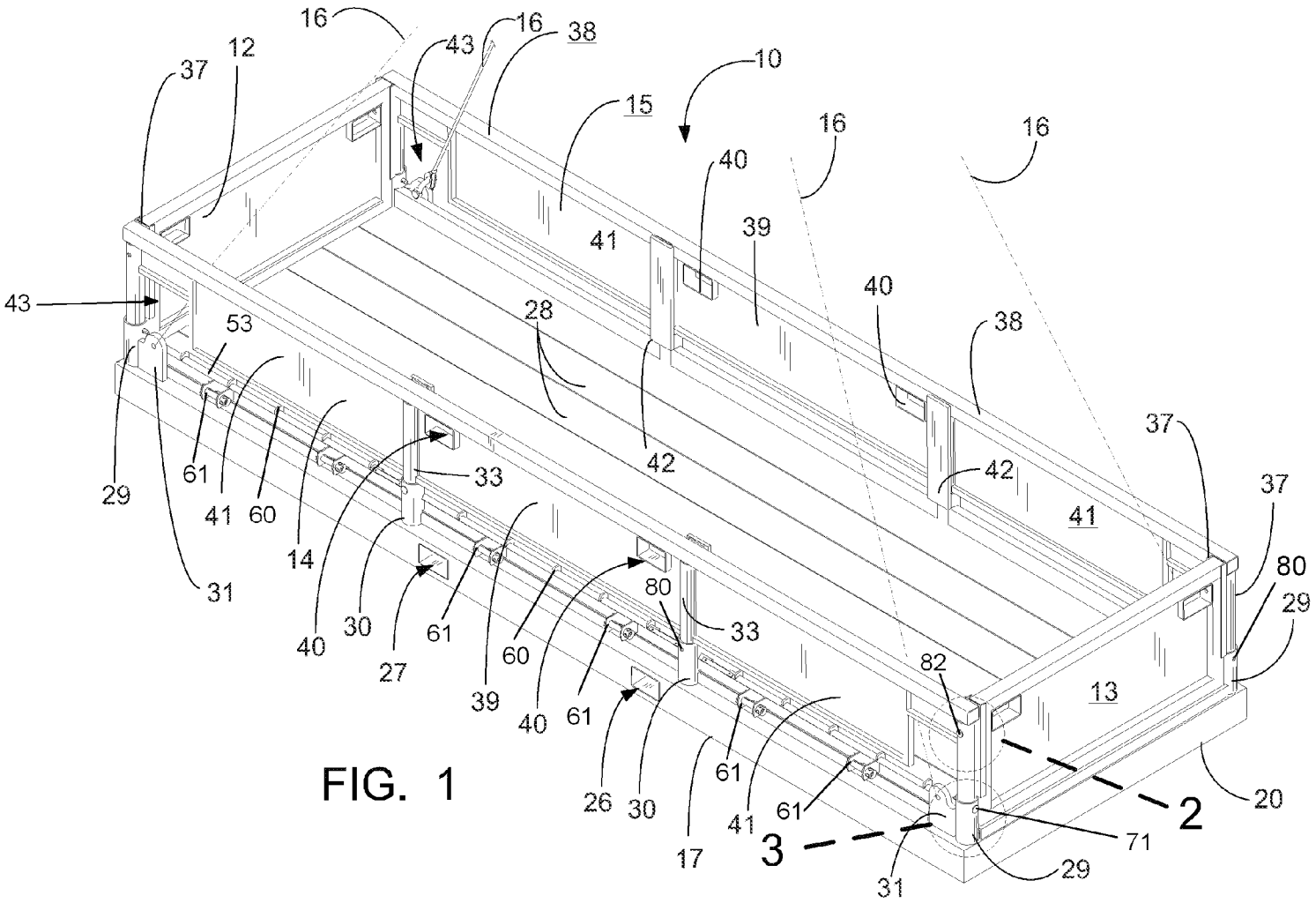
FIG. 1 is a perspective view of a preferred embodiment of the apparatus of the present invention.
Figure 22:
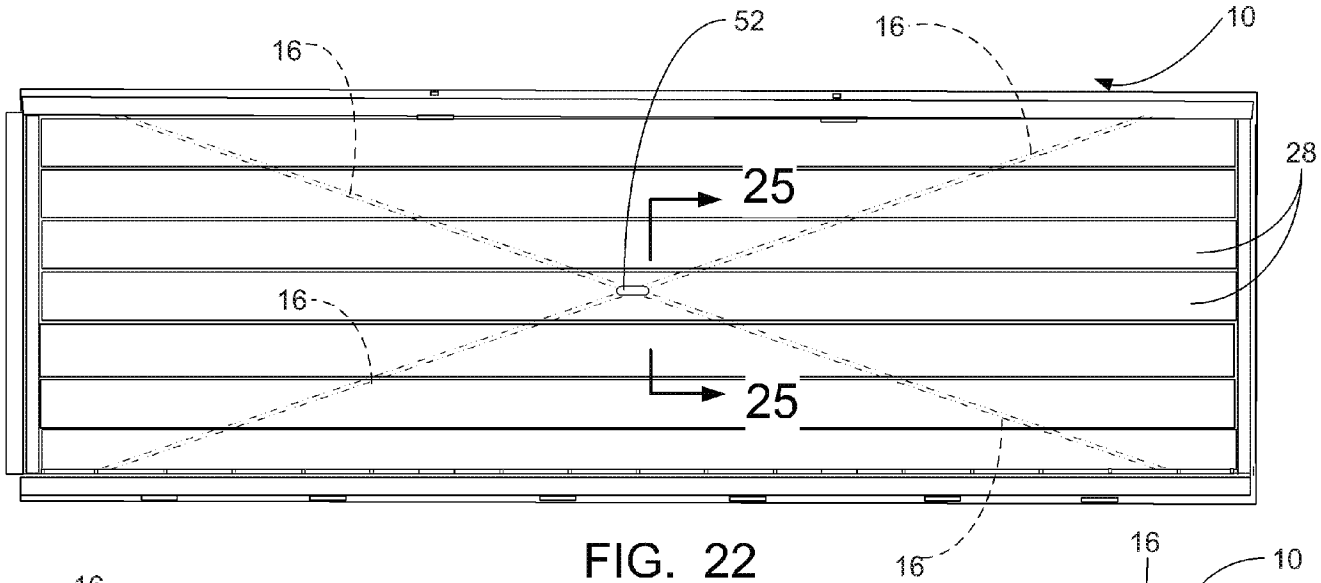
FIG. 22 is a top view of a preferred embodiment of the apparatus of the present invention.
Figure 24:
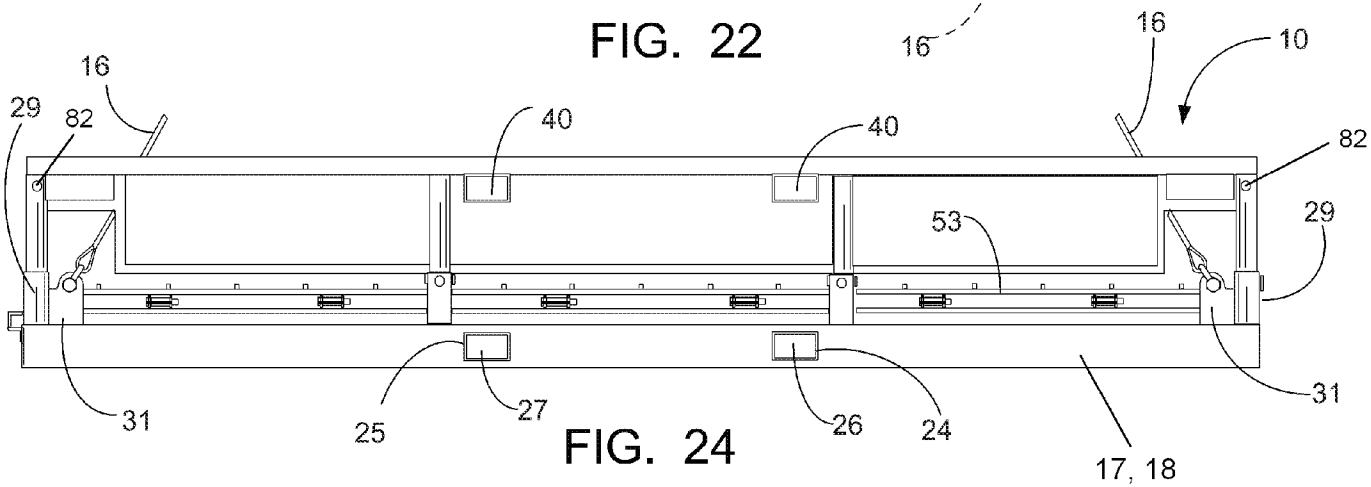
FIG. 24 is an elevation view of a preferred embodiment of the apparatus of the present invention.

FIGS. 1, 22, 24 show a preferred embodiment of the apparatus of the present invention designated generally by the numeral 10. Transporter apparatus 10 provides a base 11 that is best seen in FIGS. 6, 12-16. Base 11 supports a plurality of removable walls including end walls 12, 13 and side walls 14, 15 as shown in FIG. 1. Transporter apparatus 10 can be lifted with a crane, derrick or similar lifting apparatus using a plurality of lifting lines 16 as shown in FIGS. 1, 6, 22 and 24. The lifting lines 16 can be provided with loops or looped end portions for enabling each of the lifting lines 16 to attach to a crown block, lifting hook or other known lifting apparatus. Lifting lines 16 can, for example, be commercially available slings. Shackles can be also employed with the lifting lines 16 for forming a connection between each lifting line 16 and a lifting hook or like lifting implement of a crane. Shackles can also be used to form an interface or connection between each lifting line 16 and a padeye 31 which is a part of frame 11.

Typical dimensions for apparatus 10 are a length of 10-40 feet (3.05-12.2 meters), a height of 3-5 feet (0.91-1.52 meters), and a width of 3-8 feet (0.91-2.44 meters). Apparatus 10 is preferably made of carbon steel, but can be made of, for example, aluminum or stainless steel. It preferably has a weight of not more than 30,000 pounds (13,608 kilograms). The floor area loading when loaded is preferably not more than 270 pounds per square foot (1,318 kilograms per square meter).

When having dimensions of 8 feet (2.44 meters) wide by 24 feet (7.32 meters) long by 4 feet (1.22 meters) high, it can have for example a weight of 9000 pounds (4,082 kilograms) with the sides, around 5,200 pounds (2,359 kilograms) without the sides, with a working load limit of 26,000 pounds (11,793 kilograms) with the sides, around 29,800 pounds (13,517 kilograms) without the sides, with a maximum gross weight of 35,000 pounds (15,876 kilograms); the floor area loading when loaded is 135 pounds per square foot (659 kilograms per square meter).

Figure 6:
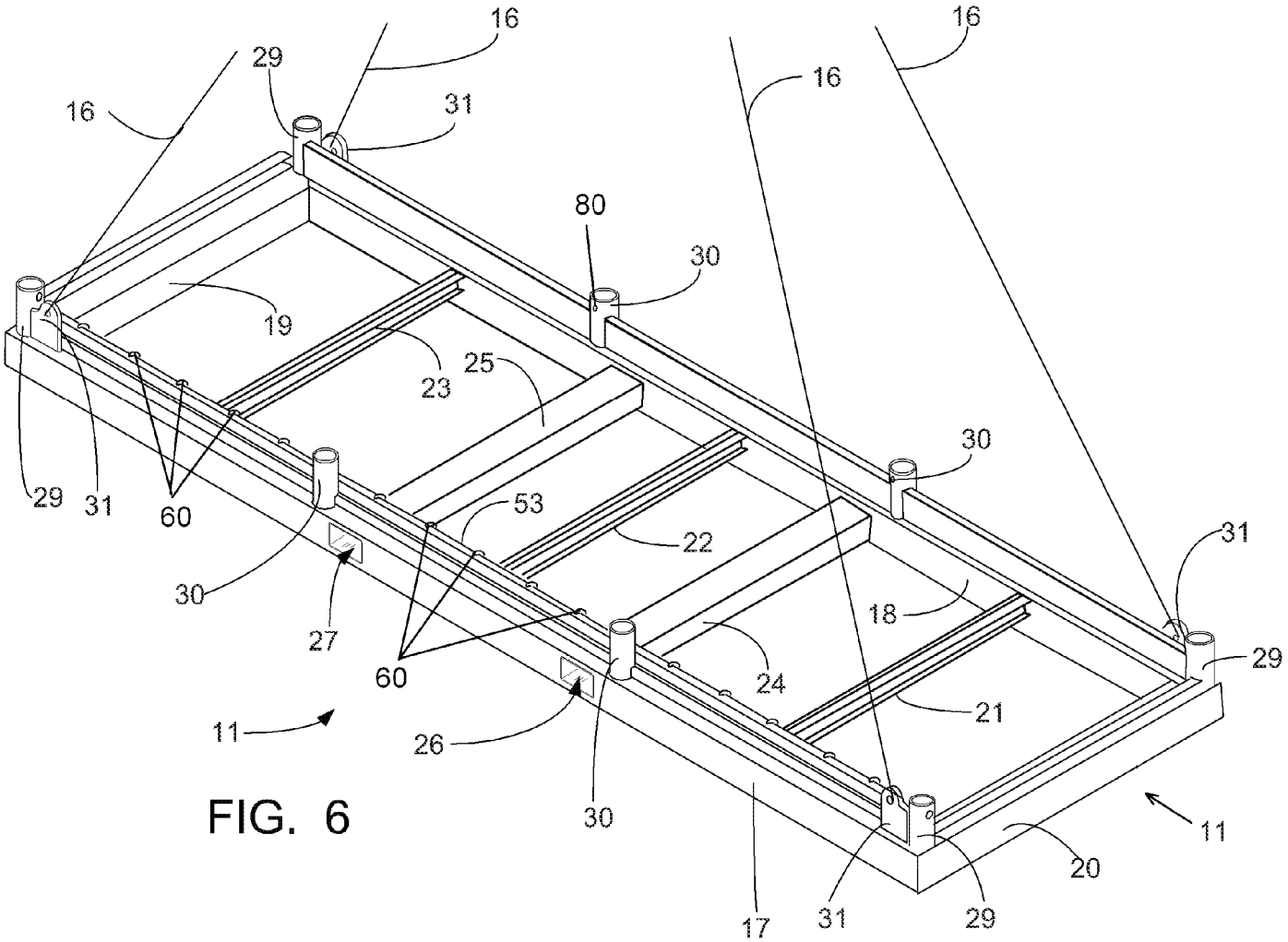
FIG. 6 is a partial perspective view of a preferred embodiment of the apparatus of the present invention.
Figures 13, 14, 15, 17:
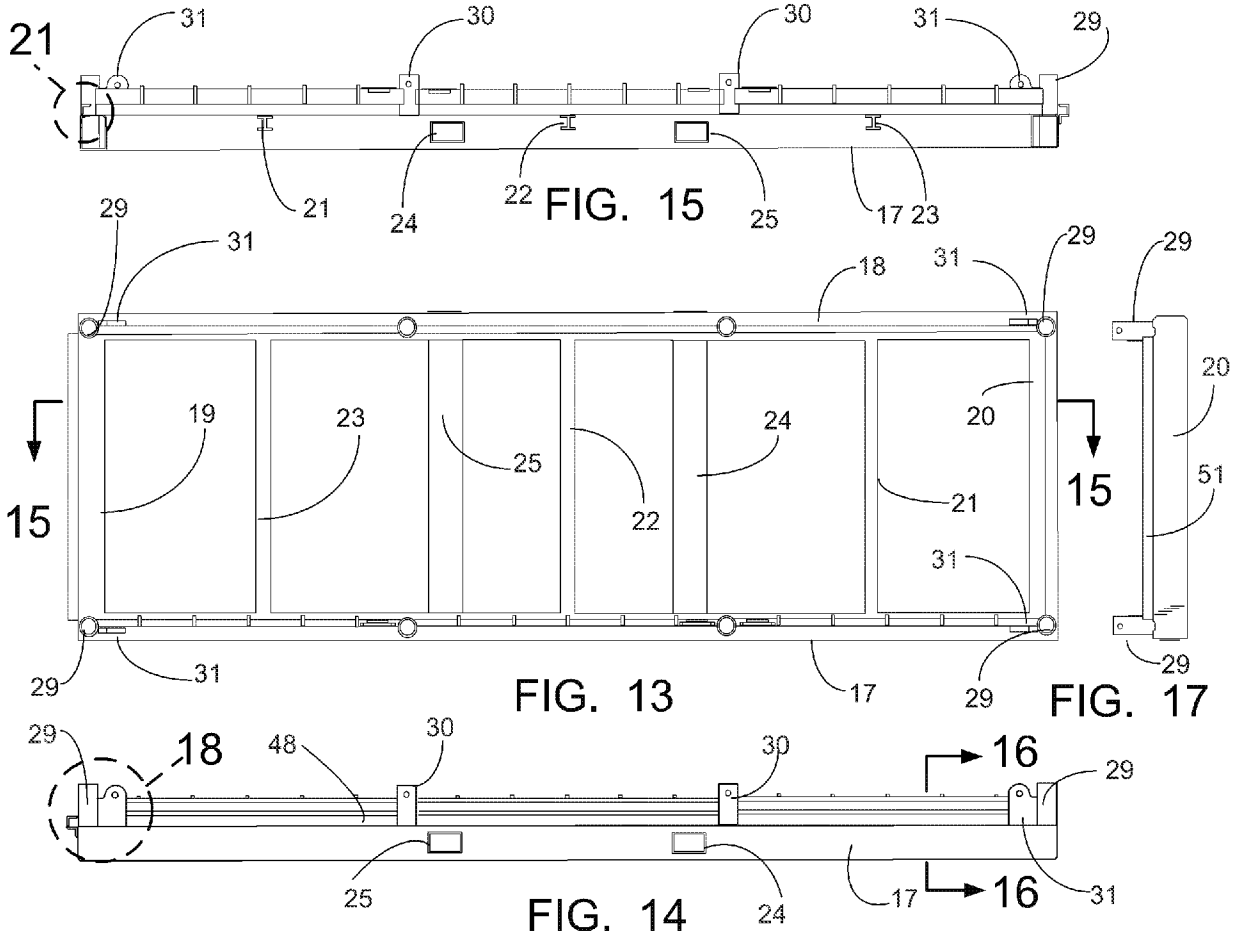
FIG. 13 is a fragmentary top view of a preferred embodiment of the apparatus of the present invention.
FIG. 14 is a fragmentary elevation view of a preferred embodiment of the apparatus of the present invention.
FIG. 15 is a sectional view taken along lines 15-15 of FIG. 13.
FIG. 17 is a fragmentary end view of a preferred embodiment of the apparatus of the present invention.
Figure 16:
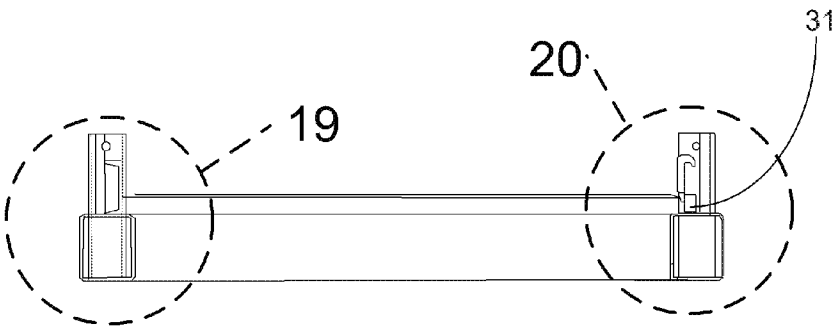
FIG. 16 is a sectional view taken along lines 16-16 of FIG. 14.
Figure 18:
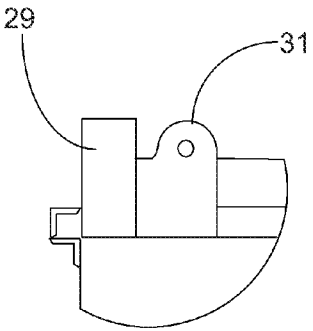
FIG. 18 is a fragmentary view of a preferred embodiment of the apparatus of the present invention.
Figure 20:
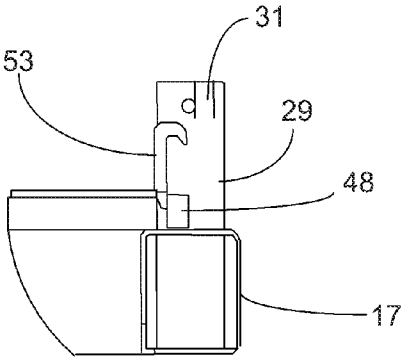
FIG. 20 is a fragmentary view of a preferred embodiment of the apparatus of the present invention.
Figure 21:
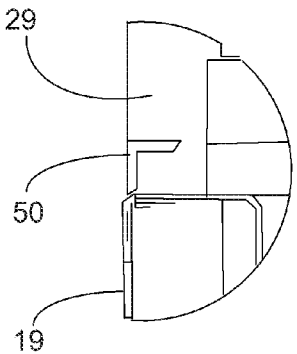
FIG. 21 is a fragmentary view of a preferred embodiment of the apparatus of the present invention.
Figure 19:
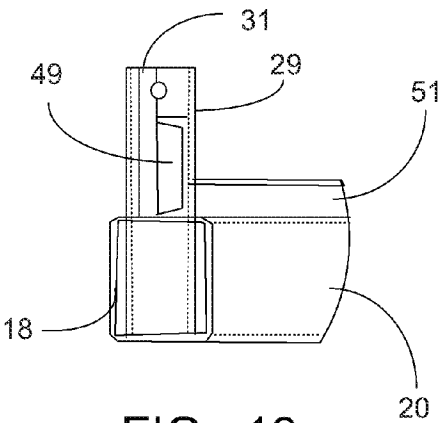
FIG. 19 is a fragmentary view of a preferred embodiment of the apparatus of the present invention.

Frame or base 11 provides a pair of side beams 17, 18 and a pair of end beams 19, 20. The side beams 17, 18 are each welded to the end beams 19, 20 using welded connections, for example. Transverse beams 21, 22, 23 span between the side beams 17, 18 as shown in FIGS. 6 and 13. Hollow beams 24, 25 also span between the side beams 17, 18. The base or frame 11 is covered with decking 28. The decking 28 can be individual wooden blanks or the like.

Hollow beams 24, 25 provide a bore or socket 26, 27. Each bore or socket is receptive of a tine of a forklift. The apparatus 10 can thus be lifted using either a crane or like lifting line when the apparatus 10 is rigged with lifting line 16 or a forklift when the tines of the forklift engage the sockets or bores 26, 27 of the beams 24, 25.

A corner tube or socket 29 is placed next to each corner of the frame 11, as well as next to a padeye 31. The padeye 31 and corner tube 29 interface 32 can be welded. In this fashion, a very rigid corner construction is provided with the padeye 31 being welded to a side beam 17 or 18 or end beam 19, 20 and to a corner tube or socket 29 (see FIGS. 16-21, 26). Additionally, the corner tube or socket 29 is welded to a side beam 17 or 18 or end beam 19, 20.

The side beams 17, 18 and end beams 19, 20 form a perimeter or perimeter beams of frame or base 11. A smaller plurality of beams is attached (for example, welded) to the top of each of the side beams 17, 18 and end beams 19, 20. These smaller beams include smaller side beams 48, 49 and smaller end beams 50, 51. In addition to the corner tubes or sockets 29, there are provided intermediate tubes and sockets 30. These intermediate tubes 30 are place in between the padeyes 31 at opposing end portions of each of the side beams 17, 18 as seen in FIG. 6.

Figure 4:
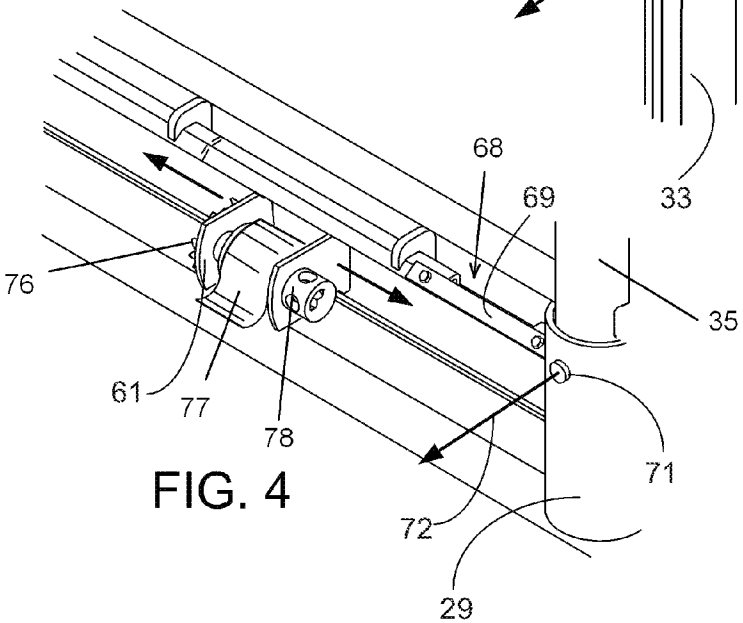
FIG. 4 is a fragmentary view of a preferred embodiment of the apparatus of the present invention.
Figure 3:
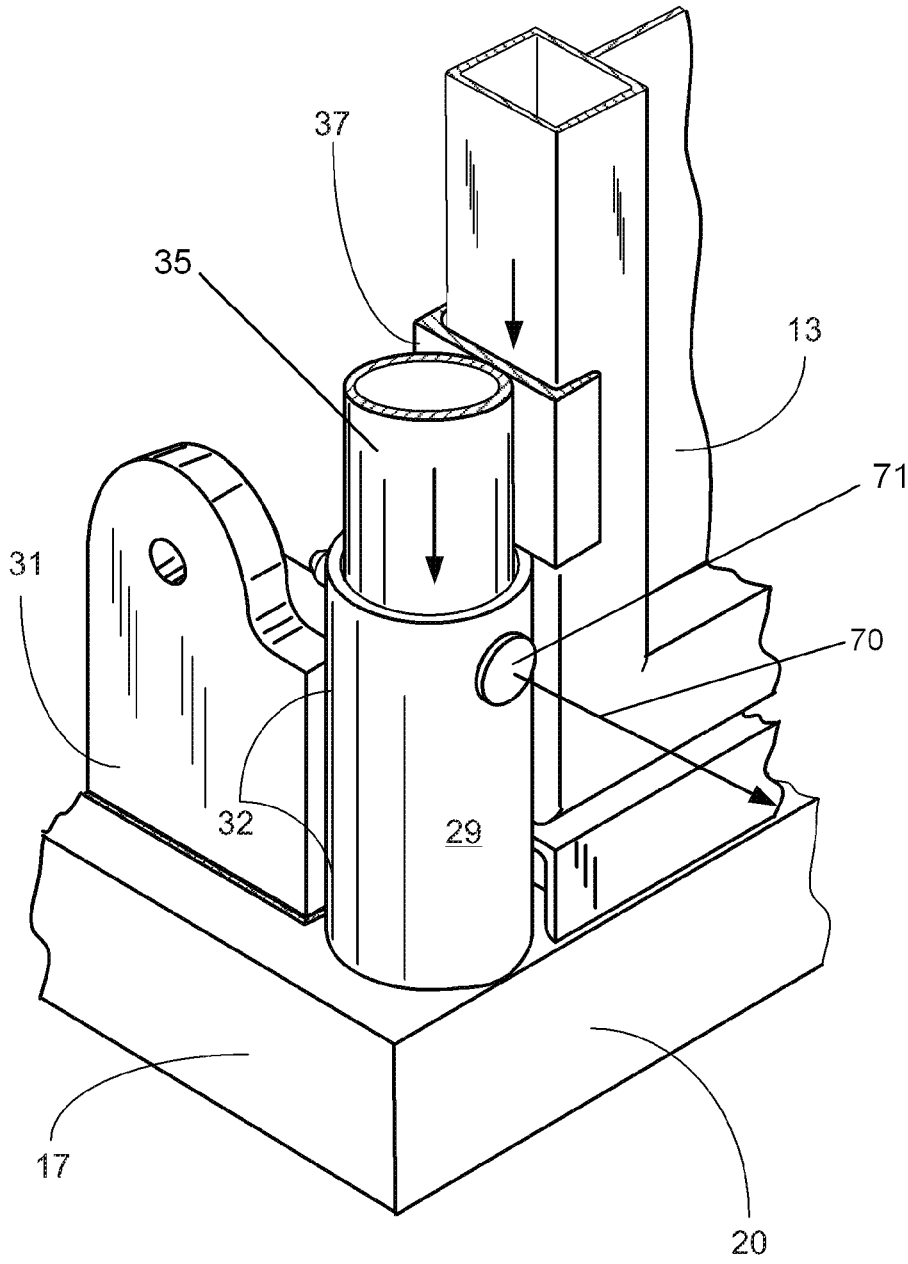
FIG. 3 is a fragmentary view of a preferred embodiment of the apparatus of the present invention.
Figures 7, 8, 9:
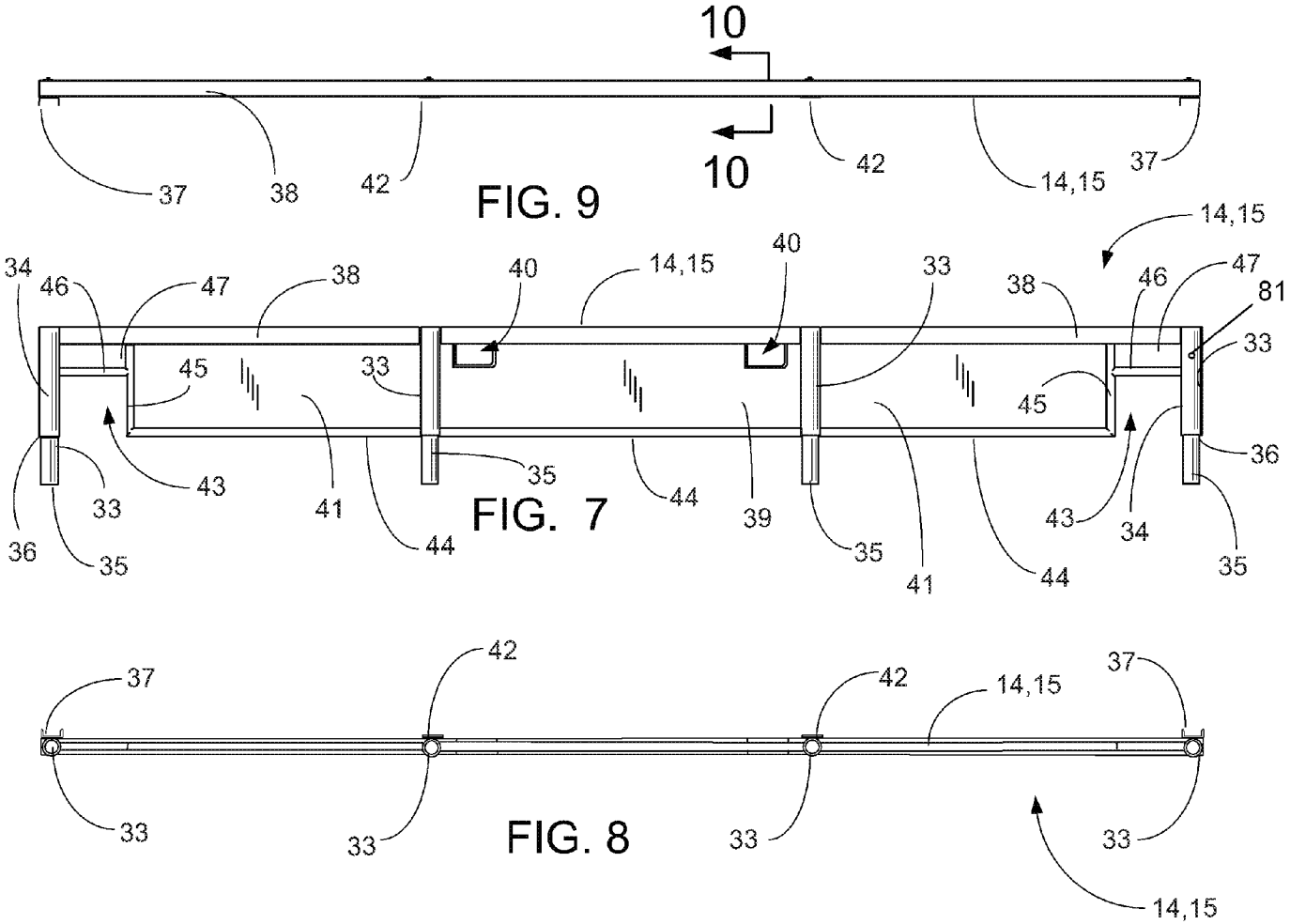
FIG. 7 is a partial elevation view of a preferred embodiment of the apparatus of the present invention illustrating the removable side rails.
FIG. 8 is a bottom view of the side rail of FIG. 7.
FIG. 9 is a top view of the side rail of FIG. 7.

Each of the side walls 14, 15 is provided with a plurality of columns 33 (see FIGS. 1, 7-9). Each column 33 has a larger diameter section 34 and a smaller diameter section 35. An annular shoulder 36 is provided at the interface between each larger diameter section 34 and smaller diameter section 35 as shown in FIG. 7. Smaller diameter section 35 fits into corner tube or socket 29 or into an intermediate tube or socket 30. A pinned connection 71 in opening 80 can be used to secure smaller diameter section 35 of a column 33 to a socket or tube 29 or 30 as indicated by arrow 72 in FIGS. 4,5.

Figure 2:
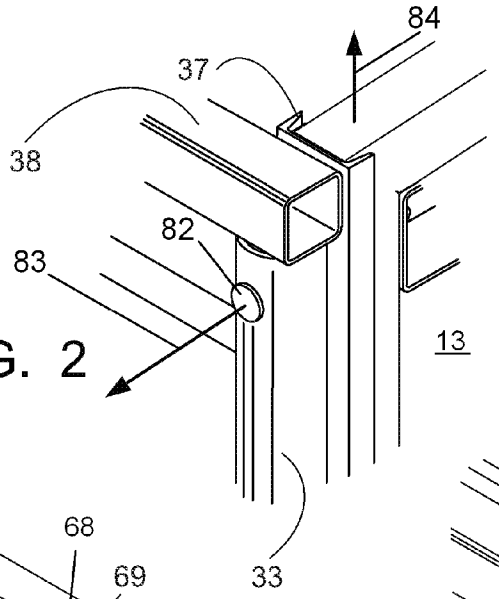
FIG. 2 is a fragmentary view of a preferred embodiment of the apparatus of the present invention.

Channels 37 are placed on each side wall 14, 15. In FIG. 9, a side wall 14 or 15 has a channel 37 at one end portion and a channel 37 at the other end portion. These channels 37 are receptive of an end wall 12, 13 as shown in FIGS. 1-2. A pinned connection 82 in opening 81 can be used to secure end wall 12, 13. If you pull pinned connection 82 in the direction of arrow 83, one is able to lift end wall 12, 13 upwardly in the direction of arrow 84, as indicated in FIG. 2. Each side wall 14, 15 provides a rail 38, center panel 39, side panels 41 and openings at 40. Openings 40 enable a user to remove a side wall 14 or 15. The side wall 14 or 15 can be removed by grasping rail 38 at openings 40 and lifting upwardly. Plates 42 are placed on two of the innermost columns 33 as seen in FIG. 1. The plates 42 face inwardly, toward a cargo that is to be contained and transported.

Figure 11:
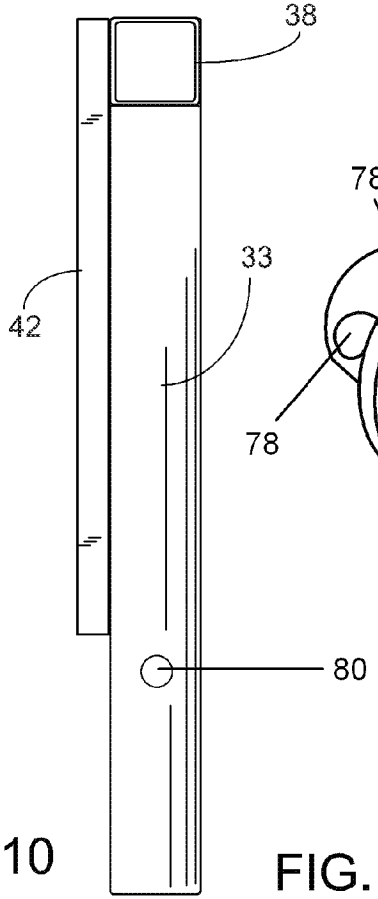
FIG. 11 is an end view of a side rail of FIGS. 7-10.
Figure 10:
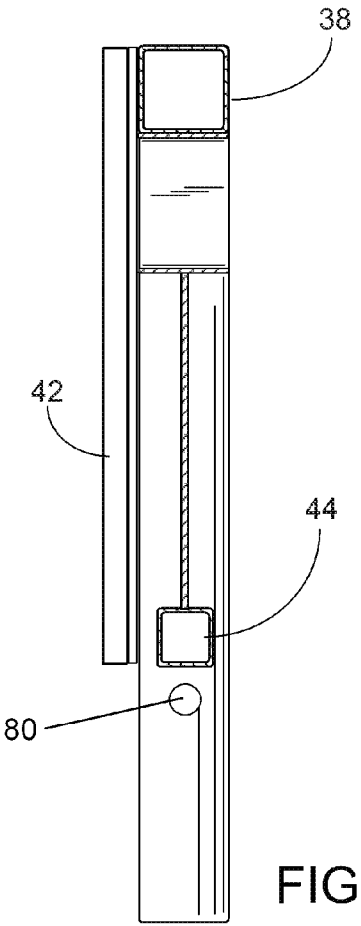
FIG. 10 is a sectional view taken along lines 10-10 of FIG. 9.
Figure 38:
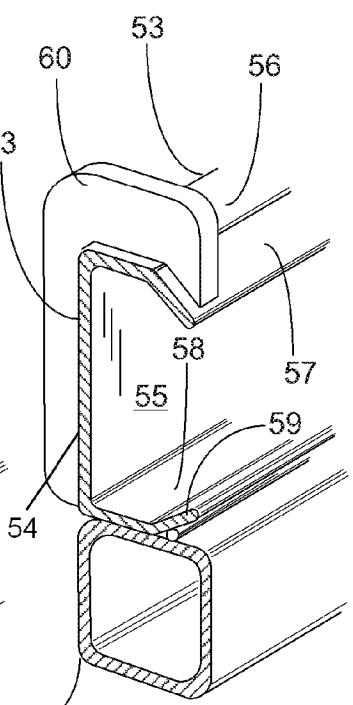
FIG. 38 is a fragmentary view of a preferred embodiment of the apparatus of the present invention.
Figure 37:
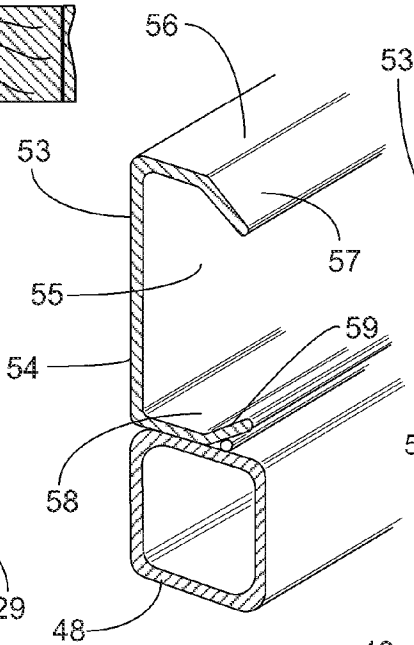
FIG. 37 is a fragmentary view of a preferred embodiment of the apparatus of the present invention.
Figure 34:
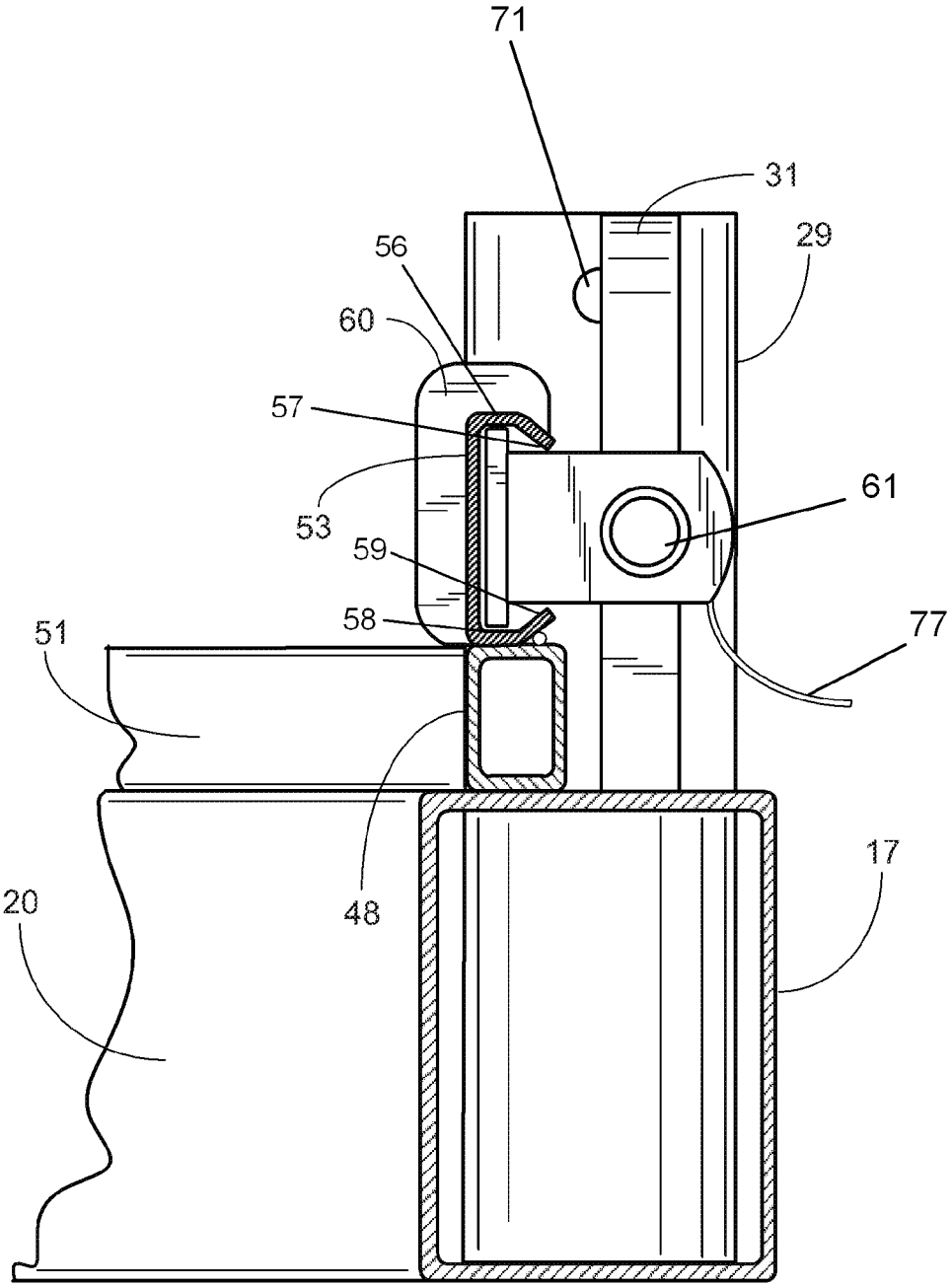
FIG. 34 is a fragmentary perspective view of a preferred embodiment of the apparatus of the present invention.

Openings or slots 43 are provided at each end portion of a side wall 14 or 15 as shown in FIG. 7. These openings or slots 43 enable a lifting line 16 to extend from a padeye 31 upwardly to a lifting implement 52 that is generally centered in between a pair of the side walls 14, 15, in between end walls 12, 13 and generally centered upon decking 28 as shown in FIG. 22 where the lifting implement, hook or the like is schematically illustrated by the numeral 52. A long horizontal beam 44 extends along the bottom of each of the center panel 39 and side panels 41 as shown in FIGS. 7 and 10. A vertical beam 45 extends upwardly along one edge of each side panel 41 as shown in FIG. 7. A small end panel 47 is provided above each opening 43. This small end panel 47 is surrounded by column 33, rail 38, vertical beam 45, and short horizontal beam 46 (see FIGS. 7, 11). A winch rail 53 extends along the top of the smaller side beam 48 as shown in FIGS. 6, 31, 32, 34, 37 and 38. In FIGS. 34 and 37-38, the winch rail 53 includes a channel 54 having web 55 upper flanges 56, 57 and lower flanges 58, 59. The channel 54 is longitudinally extending. As shown in FIGS. 37 and 38, the web 54 and the flanges 56-59 extend longitudinally along smaller side beam 48. Vertical flanges 60 are attached (for example, welded) to the winch rail 53 at intervals as shown in FIGS. 31-34. End walls 12, 13 (FIGS. 27-30) can each have an upper side rail 38, side rails 74, bottom rail 73, and center panel 39 and openings 40. Openings 40 enable a user to remove an end wall 12 or 13. The end wall 12 or 13 can be removed by grasping a rail 38 at openings 40 and lifting upwardly.

Figure 5:
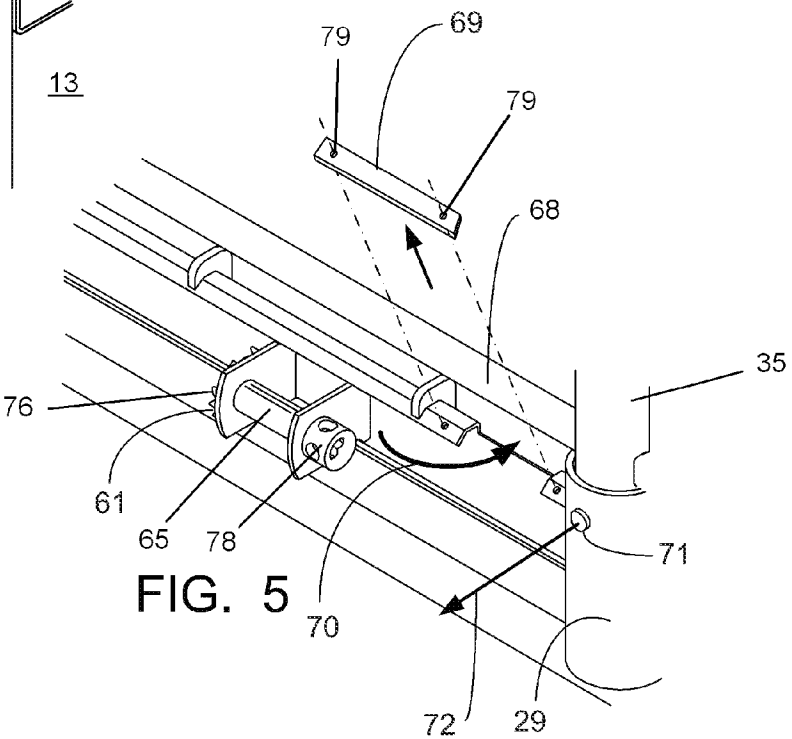
FIG. 5 is a fragmentary view of a preferred embodiment of the apparatus of the present invention.
Figure 12:
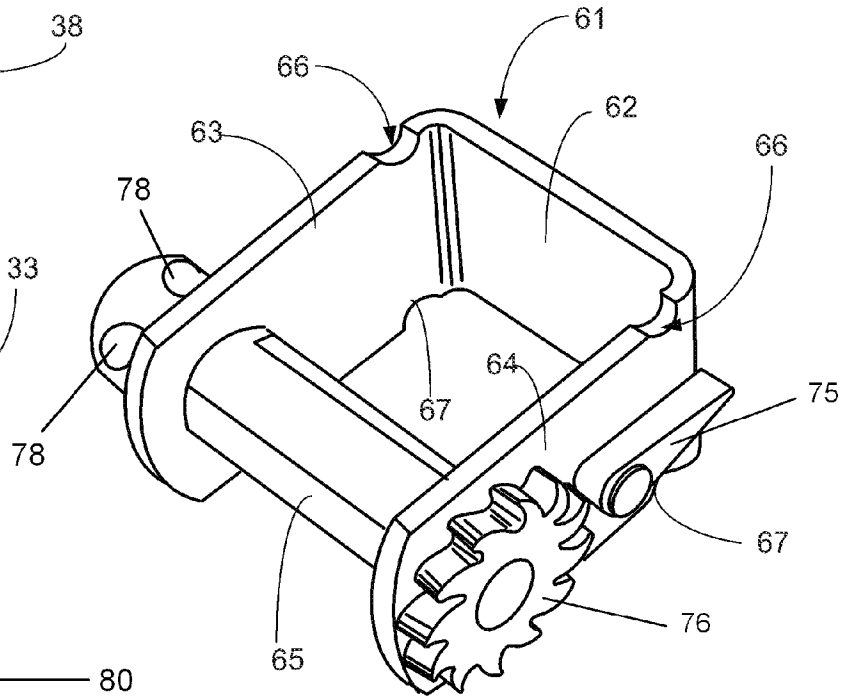
FIG. 12 is a fragmentary perspective view illustrating a winch that is attachable to a slide rail.
Figure 23:
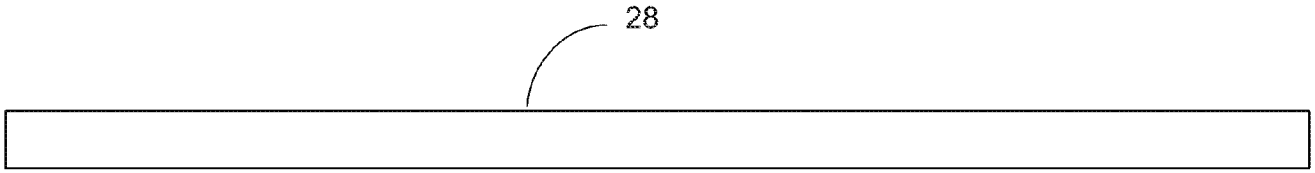
FIG. 23 is a fragmentary top view of a preferred embodiment of the apparatus of the present invention illustrating a portion of the decking.
Figure 25:
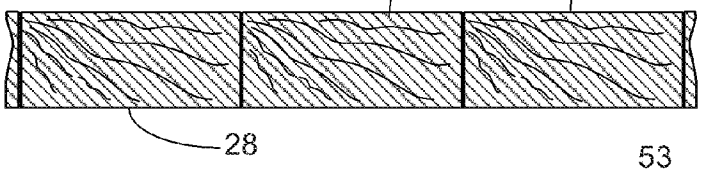
FIG. 25 is a sectional view taken along lines 25-25 of FIG. 22.
Figure 26:
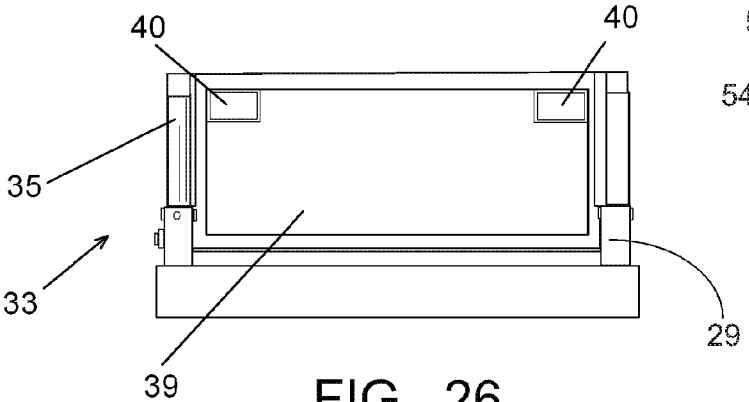
FIG. 26 is an end view of a preferred embodiment of the apparatus of the present invention.
Figures 27, 28, 29, 30:
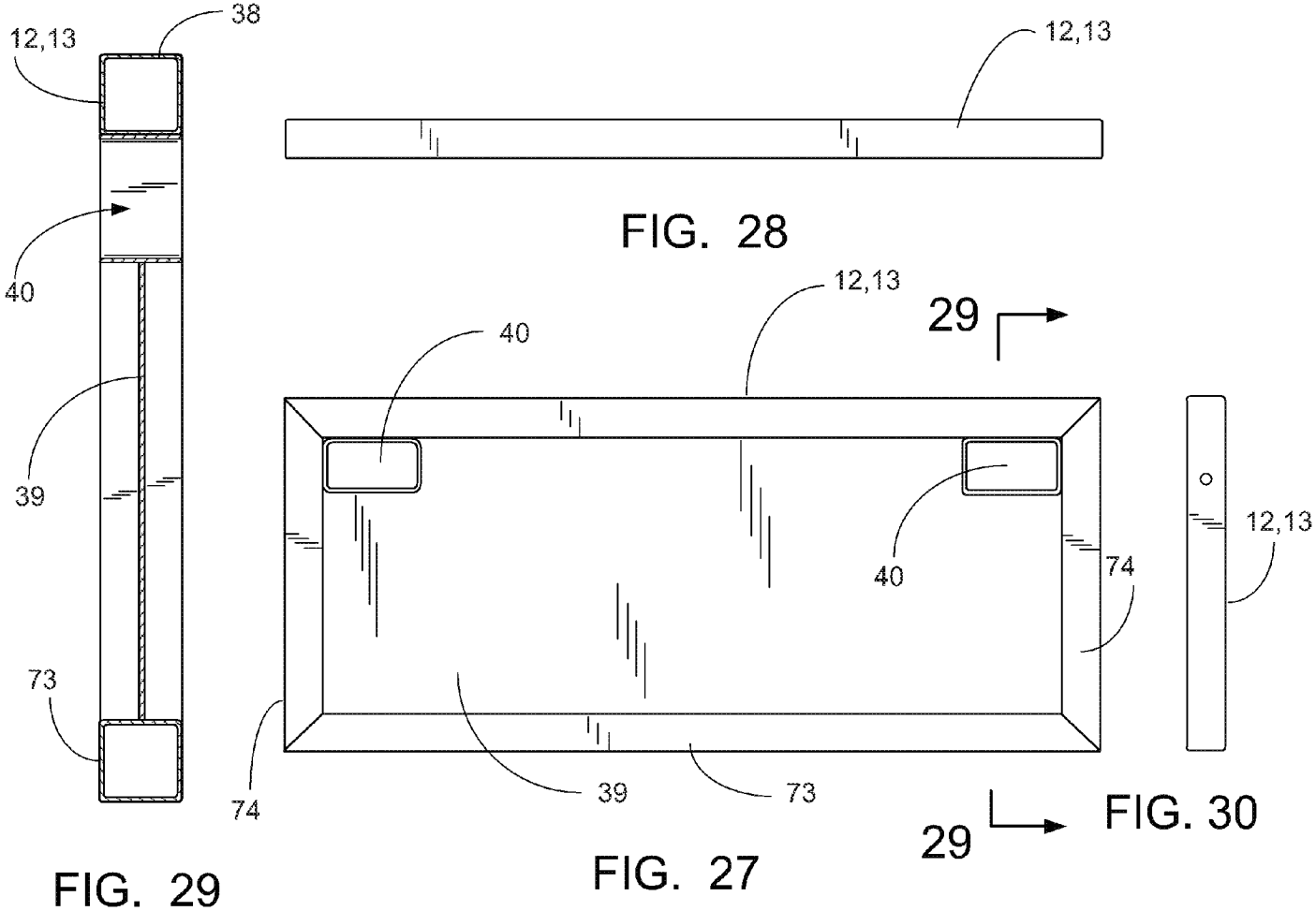
FIG. 27 is a fragmentary end view of a preferred embodiment of the apparatus of the present invention.
FIG. 28 is a fragmentary top view of a preferred embodiment of the apparatus of the present invention.
FIG. 29 is a sectional view taken along lines 29-29 of FIG. 27.
FIG. 30 is a fragmentary end view of a preferred embodiment of the apparatus of the present invention.
Figure 35:
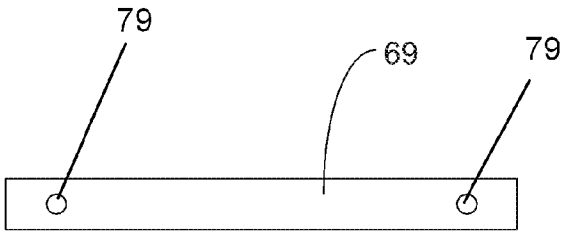
FIG. 35 is a fragmentary view of a preferred embodiment of the apparatus of the present invention.
Figure 36:
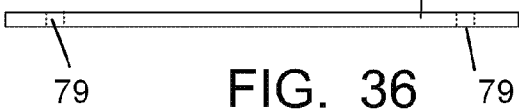
FIG. 36 is a fragmentary view of a preferred embodiment of the apparatus of the present invention.
Figure 31:
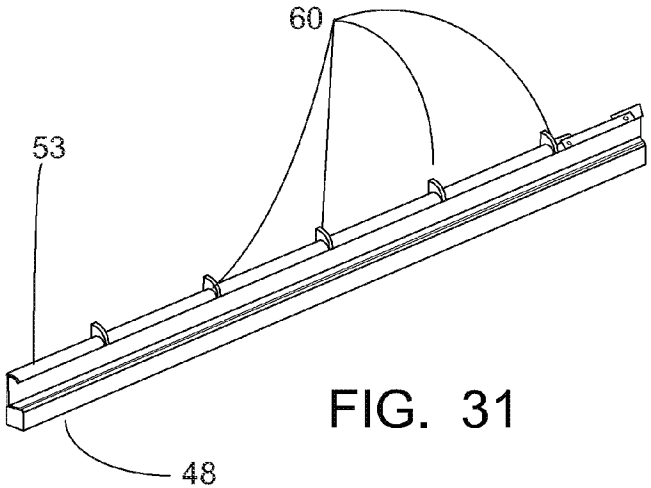
FIG. 31 is a fragmentary perspective view of a preferred embodiment of the apparatus of the present invention.
Figure 33:
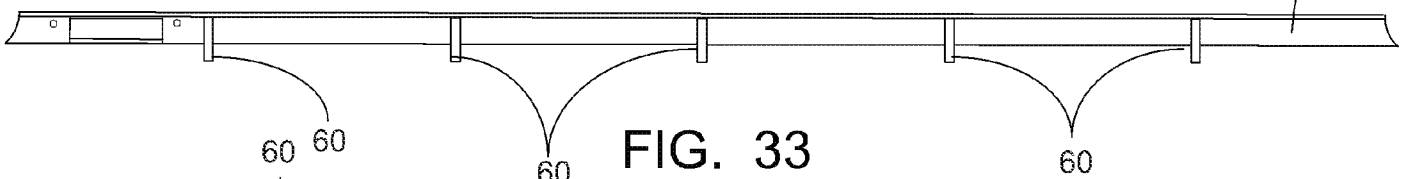
FIG. 33 is a partial top view of a preferred embodiment of the apparatus of the present invention.
Figure 32:
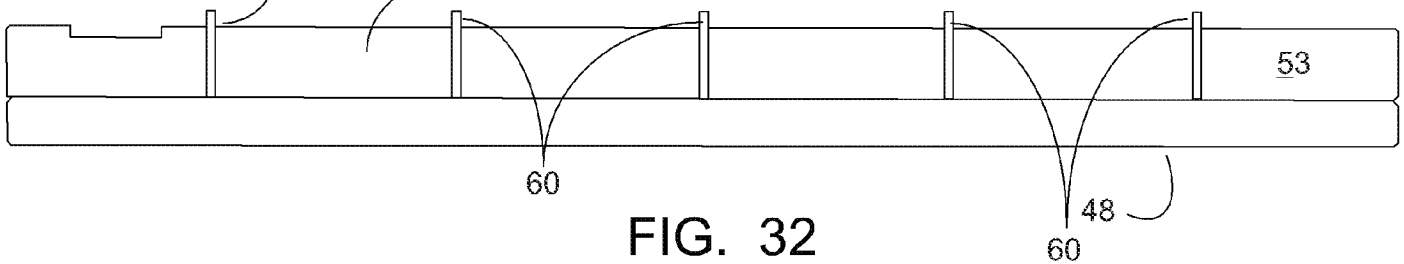
FIG. 32 is a partial side view of a preferred embodiment of the apparatus of the present invention.

Winch 61 travels in channel 54 (see FIGS. 37-38). Each winch 61 can be wound with a strap 77. Strap 77 can be tightened using winch 61 to hold cargo to the deck 28 (see FIG. 22). Winches 61 can be on both sides of deck area 28. In FIG. 12, winch 61 includes flanges 62, 63, 64, ratchet 76, and pawl 75 which engages ratchet 76. Pawl 75 and ratchet 76 function as such elements normally do in winches. Flanges 63, 64 support a spool 65. The spool can be used to tighten straps against and secure cargo that is mounted on the deck area or decking 28 (see FIGS. 23, 25). Notches 66, 67 and flanges 63, 64 are receptive of the flanges 57, 59 of the channel 54. For example, flange 57 can register in cutouts, notches or slots 66. Flange 59 engages and registers in the slots 67. Winch rail channel 53 can provide a slot or opening 68 for adding a winch to the channel 54 or removing a winch from the channel 54 (see FIGS. 4, 5). The opening or slot 68 can be closed or sealed with cover plate 69 (seen in FIGS. 35, 36) which can be attached to channel 54 at opening or slot 68 using, for example, fasteners, screws, bolted connection in openings 79 of plate 69. In FIG. 5, arrow 70 illustrates removal of a winch 61 from channel 54 via opening or slot 68. Winch 61 has a shaft or drum 77 which can be rotated using a winch drive/rotary drive 78 which can be operated with a lever.

The following is a list of parts and materials suitable for use in the present invention:

PARTS LIST

| Parts Number | Description |
|---|---|
| 10 | transporter apparatus |
| 11 | base/frame |
| 12 | end wall |
| 13 | end wall |
| 14 | side wall |
| 15 | side wall |
| 16 | lifting line |
| 17 | side beam |
| 18 | side beam |
| 19 | end beam |
| 20 | end beam |
| 21 | transverse beam |
| 22 | transverse beam |
| 23 | transverse beam |
| 24 | hollow beam |
| 25 | hollow beam |
| 26 | socket/bore |
| 27 | socket/bore |
| 28 | decking/deck area |
| 29 | corner tube/socket |
| 30 | intermediate tube/socket |

-continued

PARTS LIST

| Parts Number | Description |
|---|---|
| 31 | padeye |
| 32 | interface |
| 33 | column |
| 34 | larger diameter section |
| 35 | smaller diameter section |
| 36 | annular shoulder |
| 37 | channel |
| 38 | rail |
| 39 | center panel |
| 40 | opening |
| 41 | side panel |
| 42 | plate |
| 43 | opening/slot |
| 44 | long horizontal beam |
| 45 | vertical beam |
| 46 | short horizontal beam |
| 47 | small end panel |
| 48 | smaller side beam |
| 49 | smaller side beam |
| 50 | smaller end beam |
| 51 | smaller end beam |
| 52 | lifting implement |
| 53 | winch rail |
| 54 | channel |
| 55 | web |
| 56 | flange |
| 57 | flange |
| 58 | flange |
| 59 | flange |
| 60 | vertical flange |
| 61 | winch |
| 62 | flange |
| 63 | flange |
| 64 | flange |
| 65 | spool |
| 66 | slot/cutout/notch |
| 67 | slot/cutout/notch |
| 68 | opening/slot |
| 69 | cover plate |
| 70 | arrow |
| 71 | pinned connection |
| 72 | arrow |
| 73 | bottom rail |
| 74 | side rail |
| 75 | pawl |
| 76 | ratchet |
| 77 | winch shaft/drum |
| 78 | winch drive/rotary drive |
| 79 | opening |
| 80 | opening |
| 81 | opening |
| 82 | pinned connection |
| 83 | arrow |
| 84 | arrow |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A transporter for holding articles to be lifted, comprising:

a) a base having a plurality of perimeter beams connected to a plurality of transverse interior beams, the base having a load carrying deck with a load carrying surface, said deck extending above the transverse beams and to the perimeter beams;

b) a plurality of wall panels including multiple removable wall panels that can each be removably affixed to the base;

c) a plurality of lifting eyes secured to the base externally of the walls;

d) multiple cutout openings in said walls, each cutout enabling a diagonally placed lifting line to extend from at least one of said lifting eye, through the opening and upwardly of the base to a position above the central portion of the deck;

e) a winch rail extending along the upper surface of one of the perimeter beams; and f) wherein at least one of the wall panels with at least one of said multiple cutout openings is one of said removable wall panels.

2. The transporter for holding articles to be lifted of claim 1 wherein there are two side wall panels, each having a cutout that enables a diagonally placed lifting line to extend from the lifting eye, through the opening and upwardly of the base.

3. The transporter for holding articles to be lifted of claim 1 wherein the winch rail is rigidly affixed to the perimeter beam.

4. The transporter for holding articles to be lifted of claim 1 wherein the winch rail is generally in between a pair of said lifting eyes.

5. The transporter for holding articles to be lifted of claim 1 wherein the base has corners, and at least one of said plurality of lifting eyes is positioned at each corner.

6. The transporter for holding articles to be lifted of claim 5 wherein there is a socket at each corner that is structurally connected to both a said lifting eye and a said perimeter beam.

7. The transporter for holding articles to be lifted of claim 6 wherein said socket is receptive of a projecting portion of said wall panel.

8. The transporter for holding articles to be lifted of claim 7 wherein each said removable wall panel has a post that fits into a said socket at each corner.

9. A transporter for holding articles to be lifted, comprising:

a) a base having a plurality of larger perimeter beams which are side beams connected to a plurality of smaller perimeter beams which are end beams, and wherein a plurality of transverse interior beams attach to the side beams, the base having a load carrying deck with a load carrying surface, said deck extending above the transverse beams and to the perimeter beams, said base having four corners;

b) a plurality of wall panels including a pair of removable side wall panels and a pair of end wall panels, each said panel being removably affixed to the base;

c) a plurality of padeyes secured to the base externally of the walls, each said padeye attached to the base at a different one of said four corners;

d) multiple cutout openings in said wall panels, each cutout enabling a diagonally placed lifting line to extend from one of said plurality of padeyes, through one of said multiple cutout openings and upwardly of the base to a position above the central portion of the deck;

e) a winch rail extending along the upper surface of one of the perimeter beams; and f) wherein at least one of the wall panels with a said cutout is one of said removable wall panels.

10. The transporter for holding articles to be lifted of claim 9 wherein there are two side wall panels, each having a cutout that enables a diagonally placed lifting line to extend from the lifting eye, through the opening and upwardly of the base and further comprising four lifting lines, each line attached to a different said padeye.

11. The transporter for holding articles to be lifted of claim 9 wherein the winch rail is rigidly affixed to the perimeter beam and to at least one of said plurality of padeyes.

12. The transporter for holding articles to be lifted of claim 9 wherein the winch rail is positioned generally in between two of said plurality padeyes.

13. The transporter for holding articles to be lifted of claim 9 wherein the base has four corners, and a padeye is positioned at each corner.

14. The transporter for holding articles to be lifted of claim 9 wherein there is a socket at each corner that is structurally connected to each of one of said plurality of padeyes and one of said plurality of larger perimeter beams.

15. The transporter for holding articles to be lifted of claim 14 wherein said socket is receptive of a projecting portion of said wall panel for connecting said wall panel to the base.

16. The transporter for holding articles to be lifted of claim 15 wherein each said removable wall panel has a post that fits into each said socket.

17. The transporter for holding articles to be lifted of claim 15 wherein each said removable wall panel has sockets for enabling a worker to grip said wall panel at said opening.

18. A transporter for holding articles to be lifted of claim 9 wherein the winch rail has a channel with a concavity that faces away from the load carrying surface.

19. A transporter for holding articles to be lifted of claim 18 wherein the channel has vertically extending plates attached to the channel opposite the concavity.

20. A transporter for holding articles to be lifted, comprising:

a) a base having a plurality of larger perimeter beams which are side beams connected to a plurality of smaller perimeter beams which are end beams, and wherein a plurality of transverse interior beams attach to the side beams, the base having a load carrying deck with a load carrying surface, said deck extending above the transverse beams and to the perimeter beams, said base having four corners;

b) a plurality of wall panels including a pair of removable side wall panels and a pair of removable end wall panels, each said side wall panel being removably affixed to the base;

c) a plurality of padeyes secured to the base externally of the walls, each said padeye attached to the base at a different one of a said corner;

d) multiple cutout openings in said side wall panels, each cutout enabling a diagonally placed lifting line to extend from a said padeye, through a said cutout opening and upwardly of the base to a position above the central portion of the deck;

e) a winch rail extending along the upper surface of one of the perimeter beams; and f) wherein the end wall panels are connectable to the side wall panels.

* * * * *